US006045417A

United States Patent [19]

Igel

[11] Patent Number: 6,045,417

[45] Date of Patent: Apr. 4, 2000

[54] TERMINAL MEMBER FOR ELECTRICAL LINES

[75] Inventor: Jürgen Igel, Schwegenheim, Germany

[73] Assignee: Siemens Aktiengesellschaft, Munich, Germany

[21] Appl. No.: 09/161,547

[22] Filed: Sep. 25, 1998

[30] Foreign Application Priority Data

Sep. 25, 1997 [DE] Germany ..... 197 42 401

[51] Int. Cl.[7] ..... H01R 4/10

[52] U.S. Cl. ..... 439/877; 439/399

[58] Field of Search ..... 439/877, 430, 439/442, 730, 878, 421, 399

[56] References Cited

U.S. PATENT DOCUMENTS

| | | | |
|---|---|---|---|
| 3,611,262 | 10/1971 | Marley et al. | 439/877 |
| 3,828,298 | 8/1974 | Schumacher | 439/442 |
| 4,840,578 | 6/1989 | Sato | 439/877 |
| 5,018,986 | 5/1991 | Freitag | 439/421 |
| 5,078,617 | 1/1992 | Gutierrez et al. . | |
| 5,139,434 | 8/1992 | Goodman . | |
| 5,254,021 | 10/1993 | Yamamoto et al. | 439/877 |
| 5,733,154 | 3/1998 | Libregts | 439/877 |

FOREIGN PATENT DOCUMENTS

| | | |
|---|---|---|
| 8615615 | 9/1986 | Germany . |
| 8909562 | 1/1991 | Germany . |
| 9304392 | 6/1993 | Germany . |

*Primary Examiner*—Lincoln Donovan
*Assistant Examiner*—Hae Moon Hyeon
*Attorney, Agent, or Firm*—Herbert L. Lerner; Laurence A. Greenberg; Werner H. Stemer

[57] ABSTRACT

A crimp connector, particularly for insulated electrical lines, the crimp legs in the terminal region are formed with inwardly torn-out retaining lugs. In configurations with a plurality of identical terminal members, lines of different cross sections can be processed at all the terminal members at the same time with one processing tool and without crimping stroke adjustment.

7 Claims, 2 Drawing Sheets

TERMINAL MEMBER FOR ELECTRICAL LINES

BACKGROUND OF THE INVENTION

Field of the Invention

The invention relates to a terminal member for electrical lines which is formed in a cross-sectionally U-shaped terminal region for the line with at least one pair of mutually opposing crimp legs.

Terminal members of that type are described in German utility models DE 89 09 562 U1 (Gebrauchsmuster) and DE 93 04 392 U1 (Gebrauchsmuster), where they form the terminal part of a contact element with an insulation-piercing terminal and crimping connection.

In the prior art terminal members, the terminal region is designed for an insulated electrical line with one or more pairs of crimp legs and it is generally designed for lines of one particular diameter. If a plurality of such identical terminal members are to be used as a component part of a contact, for example in a contact housing of an electrical plug-in connector, and lines of different diameters are to be connected, they must be attached to the terminal members with processing tools that are specifically made to match the respective line diameter. A practical example is a multi-pole contact housing fully occupied with contacts, in which lines with a line cross section of, say, 0.35 and 0.5 $mm^2$ are processed. In a first process step, for example, the lines of the smaller cross section thereby have to be attached one after the other with a special tool to the contacts provided for them. In a second process step, the lines of the larger cross section have to be attached one after the other, again with a special tool, to the remaining contacts. This results in a process which is time-consuming and expensive in terms of manufacturing assembly tools.

SUMMARY OF THE INVENTION

It is accordingly an object of the invention to provide a connection terminal for electrical cables, which overcomes the above-mentioned disadvantages of the heretofore-known devices and methods of this general type and which brings about a simple and lower-cost solution for the crimping connection of different line diameters.

With the foregoing and other objects in view there is provided, in accordance with the invention, a terminal member for an electrical line, comprising:

- a U-shaped terminal region for connecting to an electrical line, the terminal region being formed with at least one pair of mutually opposite crimp legs;
- each of the crimp legs having a wall with at least one retaining lug torn out from the wall and bent inward towards a respectively opposite crimp leg, each the retaining lug having a free end; and
- the retaining lugs being disposed such that the free ends of two mutually opposite retaining lugs of a pair of crimp legs face towards one another.

In accordance with an added feature of the invention, the retaining lugs are formed at mutually opposite locations of the crimp legs and are aligned with one another in a bent-inward state.

In accordance with an additional feature of the invention, the terminal region has a bottom wall, and the retaining lugs extend parallel to the bottom wall.

In accordance with another feature of the invention, the electrical line to be connected to the terminal region has a given line diameter, and the retaining lugs have a length matched to the given line diameter.

In accordance with a further feature of the invention, the terminal region has side walls, and the crimp legs are formed in the side walls.

In accordance with again a further feature of the invention, the terminal region includes insulation-piercing terminal locations, and the crimp legs are formed at the insulation-piercing terminal locations.

In accordance with a concomitant feature of the invention, the terminal region formed with the crimp legs and the insulation-piercing terminal locations forms a terminal part of a contact element for electrical plug-in connections together with a contact region adjacent the terminal region.

In other words, the object of the invention is satisfied with the at least one retaining lug that is torn out from the wall of each crimp leg and bent inward in the direction of the opposite leg. Mutually opposite retaining lugs of a pair of crimp legs face toward one another with their free ends.

The crimp legs are provided with retaining lugs for the electrical line. The retaining lugs are torn out from the wall of a crimp leg and bent inward. In the case of terminal members, which are usually produced in a punching and bending process—in particular if they form the terminal part of a contact element for electrical plug-in connections—the tearing out of the retaining lugs is made possible by corresponding separating cuts being made in the wall of the crimp legs. In order to obtain retaining lugs which are directed toward one another with their free end, two mutually parallel, spaced-apart separating cuts have to be provided in the crimp legs perpendicularly to the longitudinal direction. One further separating cut has to be provided in the longitudinal direction of the line, transversely to the two parallel separating cuts.

In the state in which they have been torn out from the wall of the crimp legs and bent inward, two retaining lugs, which belong together, are at a distance from the bottom of the terminal region, that is to say that they protrude freely into the inner space between two crimp legs. Thus, the retaining lugs consequently form a rest for an electrical line to be inserted between two crimp legs for the crimping connection. In general, the electrical lines are insulated electrical lines, but it is also conceivable to fasten bare electrical conductors to a crimping connector according to the invention.

The configuration according to the invention is thus suitable in the following way for lines with different cross sections. As an example, insulated electrical lines with a line cross section of 0.35 $mm^2$ (outside diameter over the insulation about 1.3–1.4 mm) and with a line cross section of 0.5 $mm^2$ (outside diameter of the insulation about 1.6 mm) are assumed. When attaching the lines of smaller cross section, the insulated line lies on the retaining lugs after the rolling in of the crimp legs, over the line insulation. The retaining lugs thereby penetrate slightly into the insulation. When attaching the lines of larger cross section, the insulated line forces the retaining lugs downward, in other words back into the wall of the crimp legs, and then rests on the bottom of the terminal region. The special feature of the invention thus resides in the geometry of the crimping connection, formed by the retaining lugs. The advantage is that no die stroke adjustment is required on the processing tool when lines with different cross sections are to be attached.

The novel terminal member consequently allows manufacture processing of lines with different cross sections with at least one processing tool fewer. In other words, one processing tool is saved and there is the possibility of processing all the contacts at the same time, which translates into a considerable time savings.

Optimum retaining forces are achieved in each case for the different line cross sections by a specially matched length of the retaining lugs.

Other features which are considered as characteristic for the invention are set forth in the appended claims.

Although the invention is illustrated and described herein as embodied in a terminal member for electrical lines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
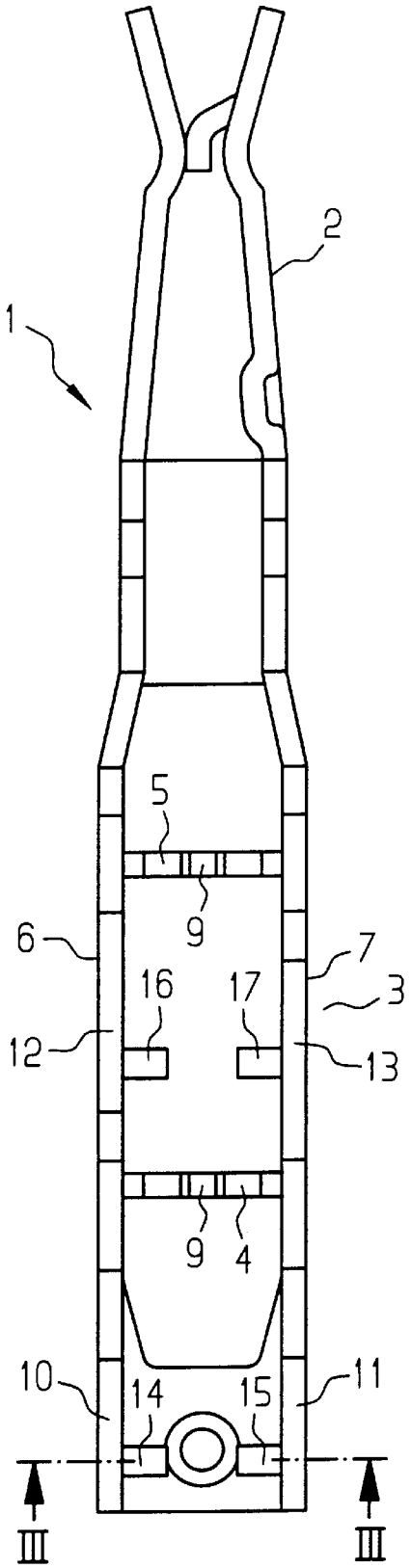
FIG. 1 is a plan view of a contact element for electrical plug-in connections.
Figure 2:
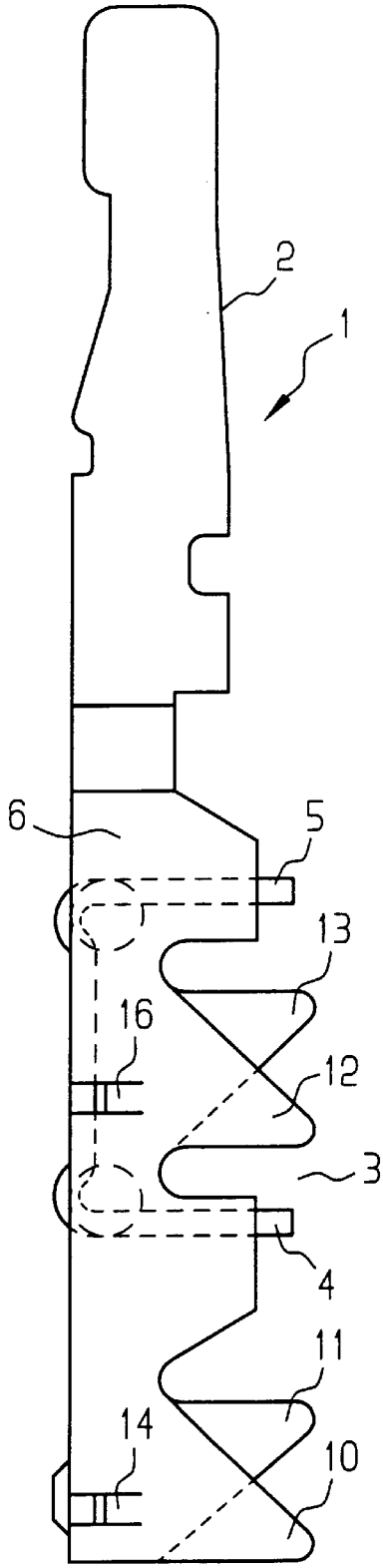
FIG. 2 is a side view of the contact element.

Referring now to the figures of the drawing in detail and first, particularly, to FIGS. 1 and 2 thereof, there is seen a contact element 1 with a contact region 2 and a terminal region 3. The contact element 1 represents a terminal member according to the invention. The contact region 2 may be formed, for example, by a contact socket or a contact spring, into which a contact pin or a contact blade of a mating contact element can be inserted. The terminal region 3 is provided with an insulated electrical conductor for the connection of the contact element 1 and has for this purpose an essentially U-shaped cross section, whereby a channel for laying in an end portion of an electrical conductor is formed. For an insulation-piercing terminal connection of the conductor, bottom-wall parts 4, 5 have been cut free from bottom 20 of the terminal region 3 and have been angled away transversely to the longitudinal direction of the terminal region 3 between side walls 6, 7 of the U shape. The parts 4, 5 project perpendicularly with respect to the bottom 20 and parallel to one another. They are spaced apart a given distance and they each have a slot 9 formed therein with two mutually opposite cutting edges 8. The insulated conductor will be inserted into the slots 9. In this way, the contact element 1 represented in FIGS. 1 and 2 is provided in each case with two insulation-piercing terminal locations, formed by the bottom-wall parts 4 and 5.

For the crimping connection of the conductor on the side of the insulation-piercing terminal location 4 facing away from the contact region 2, there is provided an outer pair of crimp legs 10, 11, which are formed in the side walls 6, 7 of the terminal region 3 and lie opposite one another. The crimp legs 10, 11 of the outer pair are shaped in the manner of shark fins and are arranged offset in opposite directions with respect to one another. Furthermore, the terminal region 3 for the crimping connection of the conductor is provided on both its longitudinal sides with a further pair of mutually opposing, identically shaped crimp legs 12, 13, which are likewise formed in the side walls 6, 7 of the terminal region 3 and, in the same way as the crimp legs 10, 11 of the outer pair of crimp legs, are offset in opposite directions with respect to one another, but as the inner pair of crimp legs are arranged between the insulation-piercing terminal locations 4 and 5. Consequently, all four crimp legs 10 to 13 have the same form and the same height, the height of the crimp legs being approximately the same as the height of the side walls 6, 7 and of the insulation-piercing terminal locations 4, 5 of the terminal region 3 before the bending over or rolling in operation. The contact element is suitable for higher tearing-out forces and, on account of its compact structural design, for contact arrangements with very small contact spacing. The attaching of the line, that is to say the pressing in of the conductor into the insulation-piercing terminal locations 4, 5, and the bending over or rolling in of the crimp legs 10 to 13, can be performed in one tool and in one operation.

Figure 3:
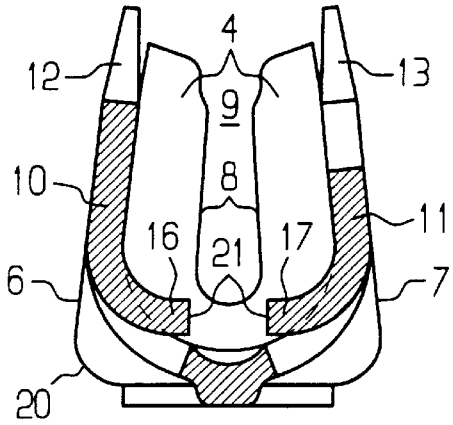
FIG. 3 is a cross-section taken along the line III—III of the contact element of FIG. 1.

Thus, to be able to realize a crimping connection for lines of different cross sections (for example 0.35 and 0.5 $mm^2$) with one and the same embodiment of a terminal member, the crimp legs 10 to 13 are formed in the following way with retaining lugs 14 to 17. After making two mutually parallel, spaced-apart separating cuts, running perpendicularly to the direction of the line, and one transverse separating cut, running in the longitudinal direction, during the production of the contact element in a punching and bending process, a narrow retaining lug 14, 15 or 16, 17 is respectively torn out from the wall of each crimp leg and is bent inward in the direction of the opposite crimp leg in such a way that two mutually opposed retaining lugs 14, 15 and 16, 17 of a pair of crimp legs 10, 11 and 12, 13, respectively, are directed toward one another with their free end 21. The retaining lugs 14, 15 and 16, 17 are in each case provided at mutually opposing locations of the crimp legs 10 to 13, so that they are aligned with one another in the bent inward state (FIG. 1). In the state in which they have been torn out from the wall of the crimp legs 10 to 13, in other words in the initial state before the crimping connection, the retaining lugs 14 to 17 run parallel and at a distance from the bottom 20 of the terminal region 3 (FIG. 3). The length of the retaining lugs 14 to 17 is matched specifically to the line diameter, in other words to an outside line diameter over the insulation of about 1.3–1.4 mm in the case of the line of smaller cross section and of about 1.6 mm in the case of the line of larger cross section.

Figure 4:
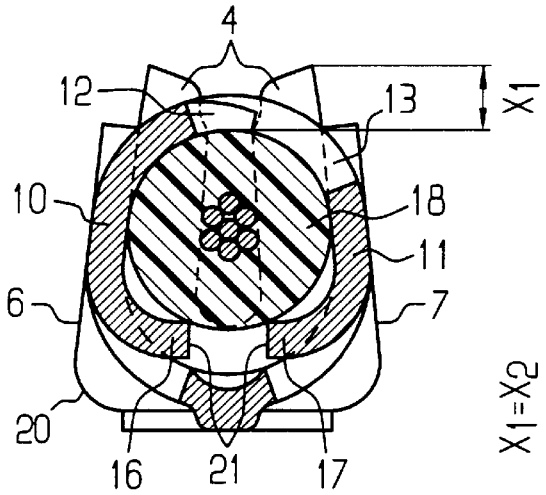
FIG. 4 is a section similar to the section of FIG. 3, with the crimping connection of an insulated electrical line.
Figure 5:
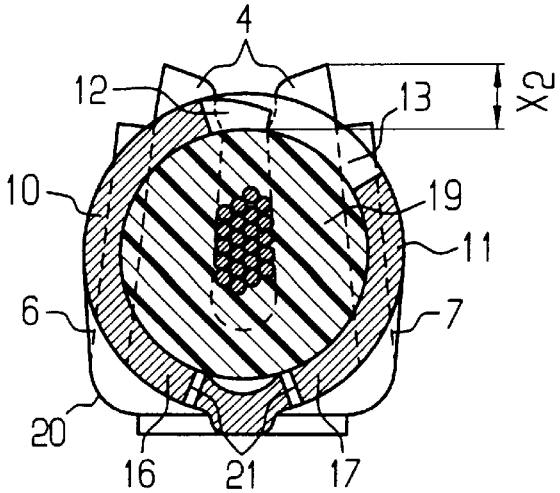
FIG. 5 is a section similar to the section of FIG. 3, with the crimping connection of an insulated electrical cable with a larger cross section than the cable of FIG. 4.

FIGS. 4 and 5 show the completed crimping connection of the two different lines. After the insulation-piercing terminal connection and the rolling in of the crimp legs 16, 17, the line 18 (for example with a cross section of 0.35 $mm^2$ and a line diameter of about 1.3–1.4 mm) rests on the retaining lugs 12 and 13, which penetrate slightly into the line insulation. The line 19 (for example with a cross section of 0.5 $mm^2$ and a line diameter of about 1.6 mm) forces the retaining lugs 16, 17 downward and back into the wall of the crimp legs, so that in the final state (FIG. 5) it rests on the bottom 20 of the terminal region 3.

In this way, one and the same construction of the crimping connector is suitable for lines with different cross sections.

As FIGS. 4 and 5 show, in both cases the crimping connection of the lines is possible without die stroke adjustment at the processing tool (X1=X2). Furthermore, optimum retaining forces are achieved for both line cross sections.

I claim:

1. A terminal member for an electrical line, comprising:

a U-shaped terminal region for connecting to an electrical line, said terminal region being formed with at least one pair of mutually opposite crimp legs;

each of said crimp legs having a wall with at least one retaining lug torn out from said wall and bent inward and upward towards a respectively opposite crimp leg, each said retaining lug having a free end; and said retaining lugs being disposed such that said free ends of two mutually opposite retaining lugs of a pair of crimp legs face towards one another;

said retaining lugs to be forced downwardly upon attachment of the electrical line depending on a size of the electrical line.

2. The terminal member according to claim 1, wherein said retaining lugs are formed at mutually opposite locations of said crimp legs and are aligned with one another in a bent-inward state.

3. The terminal member according to claim 1, wherein said terminal region has a bottom wall, and said retaining lugs extend parallel to said bottom wall.

4. The terminal member according to claim 1, wherein the electrical line to be connected to said terminal region has a given line diameter, and said retaining lugs have a length related to the given line diameter.

5. The terminal member according to claim 1, wherein said terminal region has side walls, and said crimp legs are formed in said side walls.

6. The terminal member according to claim 1, wherein said terminal region includes insulation-piercing terminal locations, and said crimp legs are formed next to said insulation-piercing terminal locations.

7. The terminal member according to claim 6, which further comprises a contact region adjacent said terminal region, and wherein said terminal region formed with the crimp legs and said insulation-piercing terminal locations forms a terminal part of a contact element for electrical plug-in connections.

* * * * *